United States Patent [19]

Soileau

[11] Patent Number: 4,959,762

[45] Date of Patent: Sep. 25, 1990

[54] LUMINAIRE CONTAINMENT MEANS FOR LAMP RUPTURING

[75] Inventor: Trasimond A. Soileau, Flat Rock, N.C.

[73] Assignee: General Electric Company, Schenectady, N.Y.

[21] Appl. No.: 241,723

[22] Filed: Sep. 8, 1988

[51] Int. Cl.[5] ..... F21V 11/00

[52] U.S. Cl. ..... 362/376; 362/375; 362/344; 362/261; 362/290

[58] Field of Search ..... 362/376, 374, 375, 263, 362/268, 344, 261, 290, 248, 294, 327, 342, 343, 299, 310

[56] References Cited

U.S. PATENT DOCUMENTS

| | | | |
|---|---|---|---|
| 2,469,412 | 5/1949 | Roebken | 362/376 |
| 3,461,283 | 8/1969 | Hahn | 362/374 |
| 4,081,668 | 3/1978 | Mori | 362/376 |
| 4,150,422 | 4/1979 | Peralta et al. | 362/376 |
| 4,516,196 | 5/1985 | Blake | 362/375 |

FOREIGN PATENT DOCUMENTS

| | | | |
|---|---|---|---|
| 296885 | 9/1928 | United Kingdom | 362/376 |

*Primary Examiner*—Stephen F. Husar
*Assistant Examiner*—D. M. Cox
*Attorney, Agent, or Firm*—John P. McMahon; Stanley C. Corwin; Fred Jacob

[57] ABSTRACT

Containment means for a luminaire that captures hot particles created by the unlikely event of a pressurized lamp rupture is disclosed. In one embodiment, the containment means comprises a mesh interposed between the lamp and a refractor of the luminaire typically formed of an acrylic material. The mesh captures hot particles having a sufficient heat capacity and temperature to create excess heat damage to the refractor.

15 Claims, 2 Drawing Sheets

LUMINAIRE CONTAINMENT MEANS FOR LAMP RUPTURING

BACKGROUND OF TUE INVENTION

This invention relates to a luminaire having means for containing hot particles of lamp components produced by the unlikely event of the lamp rupture. More particularly, this invention relates to a mesh interposed between a pressurized lamp and a refractor lens or globe of a flammable material of the luminaire for intercepting and capturing the hot particles that may be dislodged from the pressurized lamp under the unlikely rupture condition and which particles are of a sufficient temperature and heat capacity to cause excessive heat damage to the luminaire.

As disclosed in U.S. patent application Ser. No. 047,813 filed May 8, 1987 now abandoned of C. A. Willis assigned to the same assignee as the present invention, lamps under a pressurized condition, such as metal halide and tungsten-halogen lamps may experience a rupture condition. These pressurized lamps, and in particular, metal halide discharge lamps may experience the rupture condition which causes hot flying fragments to be dislodged from the lamp. Lamp failures which occur in such a manner are infrequent and although incidences of such failures are extremely minor, there is no practical way known at this time to completely eliminate the possibility of such failures.

One way of minimizing such failures in continuously operating systems is to turn the lamps, in particular the metal halide lamps, off once a week for about 15 minutes. If this procedure is followed, those lamps approaching the end of their life will either probably fail to restart before reaching a point where a chance for a non-passive rupture failure begins to increase or the failure will occur due to the arc related to the metal halide lamp being unable to withstand the thermal stresses during warm-up and the arc will fail at a low, relatively non-destructive pressure. Replacing lamps at or before the end of their rated life will also decrease the possibility of non-passive rupture failures. Another way to minimize the possible hazards associated in the unlikely event of an arc tube rupturing, is to operate the lamp in a fixture designed to contain such a failure, such as a fixture comprising a refractor or lens made of a tempered safety glass.

Glass enclosures such as tempered safety glass lenses while serving as means for containing a ruptured arc tube do not have the benefits of plastic materials. For example, plastic materials due to their weight and non-fracture characteristics avoid the hazards of having heavy chunks of borosilicate glass comprising a lens falling from luminaires that may be located in factories. Further, the light weight plastics, such as acrylic, may be more accurately molded to provide superior optical features relative to those yielded by glass. In the unlikely event of a catastrophic failure caused by the bursting of the arc tube of the metal halide lamp, it is possible for hot shards of a quartz arc tube to impinge or otherwise fall directly onto the acrylic or other flammable plastic lens or refractor which may result in burning hot plastic from the lens or refractor dripping down onto the environment located under the related luminaire. It is desired that means be provided within the luminaire to substantially reduce or even eliminate the related heat damage to the luminaire by capturing and containing any hot particles that have the potential to ignite the flammable lens or refractor of the luminaire.

Accordingly, it is an object of the present invention to provide containment means for a luminaire which largely eliminates the risk of igniting the flammable plastic lens or refractors and its related secondary fire risks.

SUMMARY OF THE INVENTION

The present invention is directed to containment means for a luminaire that intercepts and captures hot particles projected from a pressurized lamp in the unlikely event of a lamp rupturing condition and which particles are of a sufficient temperature and heat capacity to cause excessive heat damage to the luminaire.

In various embodiments, the luminaire comprises an upper housing, a pressurized lamp accommodated by the upper housing, a plastic or metal enclosure having refractor or lens attachment means, a refractor or lens connected to the attachment means, and a mesh assembly interposed between the pressurized lamp and the refractor or lens.

DETAILED DESCRIPTION OF THE PREFERRED EMBODIMENTS

Figure 1:
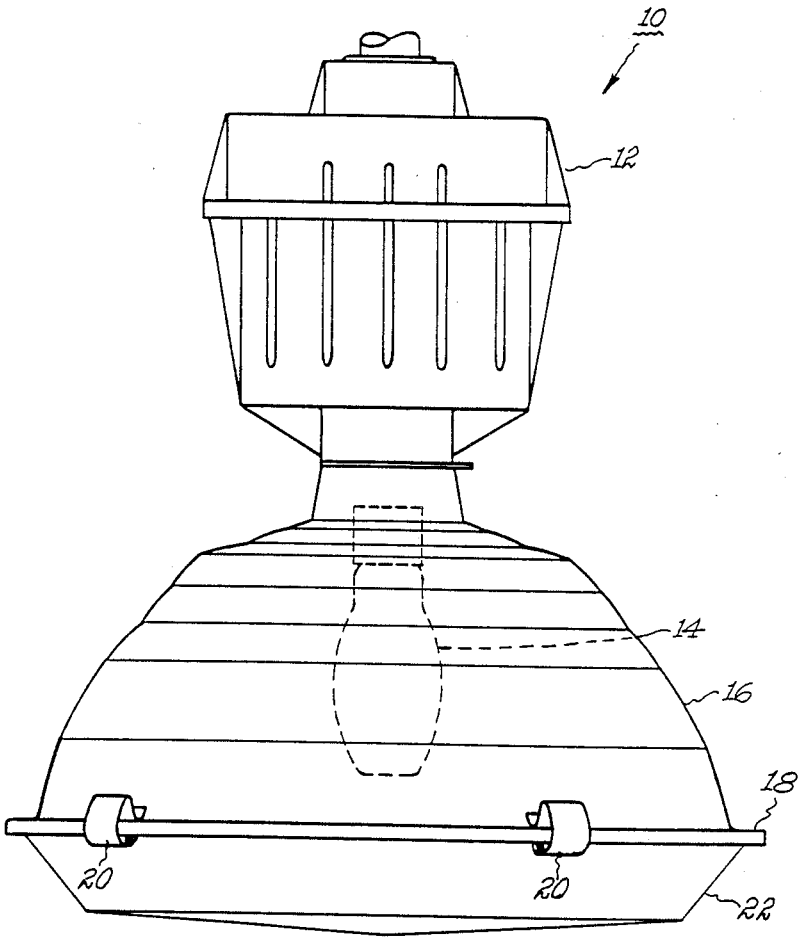
FIG. 1 is an illustration of a luminaire related to the present invention.
Figure 2:
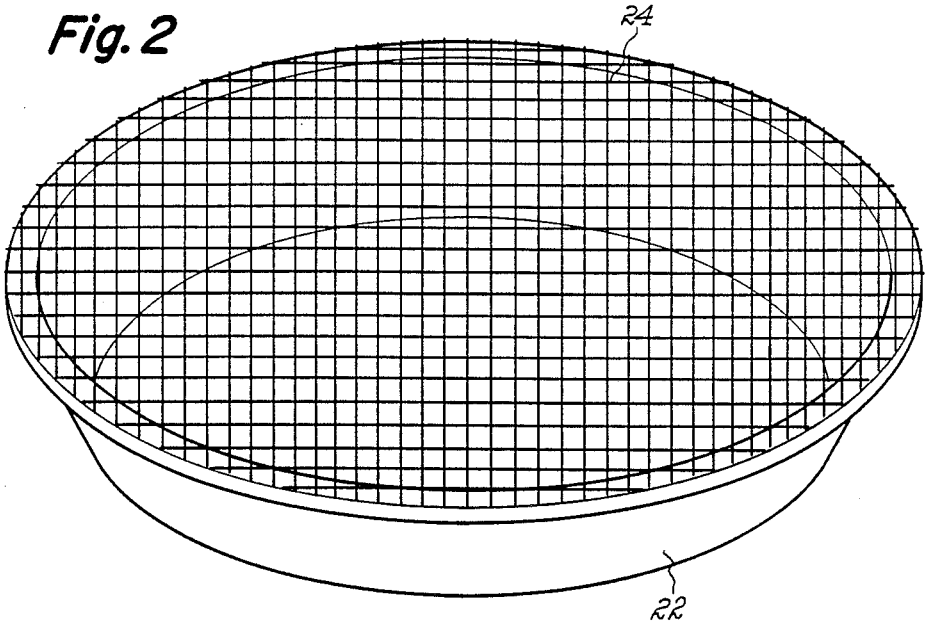
FIG. 2 is a illustration for the containment means of the present invention.

FIG. 1 illustrates a luminaire 10 related to one embodiment of the present invention. The luminaire 10 comprises an upper housing 12, a pressurized lamp such as a metal halide lamp 14 (shown in phantom) having an arc tube commonly formed of a quartz material and disposed therein and which is accommodated by the upper housing. The luminaire 10 has an enclosure 16 formed of a reflective material which for the embodiment of FIG. 1 is commonly termed a reflector. Further, the enclosure 16 of FIG. 1 may have attachment means 18 comprising clamps 20 for attaching to a refractor or lens 22 for closing the bottom or exit area from which the light generated by the luminaire is transmitted. The refractor or lens 22 serves as a window or exit area for the transmitted light. For other embodiments, the bottom portion may be opened and devoid of a window member so that the light does not encounter any transmitting medium other than air while being transmitted from the exit or window area. For the embodiment shown in FIG. 1, a refractor 22 closes the bottom portion of the luminaire 10 and is connected to attachment means 18. The luminaire 10 further comprises containment means 24 which is of particular importance to the present invention and is shown in FIG. 2.

The containment means 24 is placed on and connected to the outer rim of the window 22 and is therefore interposed between the refractor 22 and the metal halide lamp 14. Alternatively, for embodiments in which the luminaires do not have their bottom portion closed by a window member so as to provide an opened window area, the containment means may be placed on and connected to the enclosure 16 so as to be interposed between the open portion of the enclosure and the pressurized lamp 14.

In the various embodiments of the present invention, the containment means may be sealed to its supporting member and may be trimmed so as to conform to the shape of its supporting member. The containment means is preferably formed of a stainless steel material but may be of a material selected from the group consisting of steel, aluminum, brass, copper, and other high melting point metals or alloys. Further, a glass cloth, or other noncombustible insulated material may be selected for the containment means 24. Various other high melting point materials may be used so long as the mechanical integrity of the mesh is not damaged when subjected to particles of a ruptured lamp in a manner to be described. Further, in that in various embodiments the containment means 24 is interposed between the lamp 14 and window member 22, it is desired that optical characteristics of the selected material be taken into account with regard to reducing the effect of the containment means on the light output of the luminaire 10.

Figure 3:
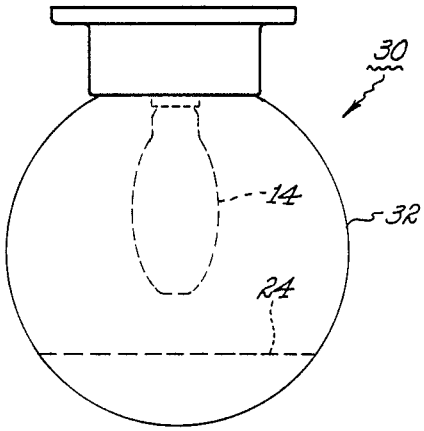
FIG. 3 illustrates a globe type luminaire having the containment means of the present invention.
Figure 4:
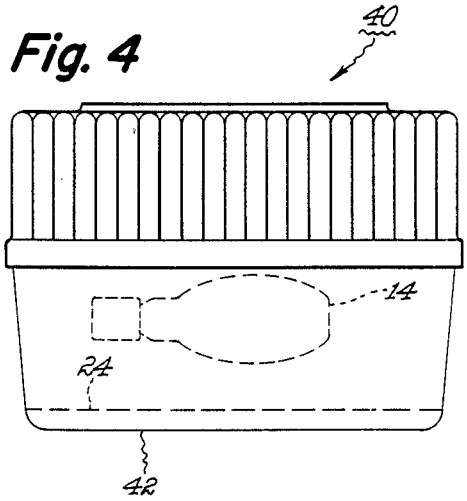
FIG. 4 illustrates a wall and ceiling mounting luminaire having the containment means of the present invention.

The containment means 24 of the present invention in addition to the embodiment of FIG. 1 may find application in a wide range of non-industrial luminaires such as a globe type enclosure 30 shown in FIG. 3 or a wall and ceiling mounting type 40 shown in FIG. 4. The shape of the luminaires 30 and 40 is not critical and each such luminaire has an enclosure or window member having a function similar to the reflector 16 or refractor 22, respectively, discussed with regard to FIG. 1. The luminaire 30 has a window member in the shape of a globe 32 completely or partially encompassing the pressurized lamp 14 and controlling the light emitted therefrom. Similarly, luminaire 40 has a window member 42 having a rectangular form completely or partially encompassing the pressurized lamp 14 and controlling the light emitted therefrom. In the luminaires 30 and 40, the containment means 24 is interposed between the pressurized lamp 14, accommodated by the upper housing of each luminaire, and globe 32 and the rectangular device 42 respectively.

The window member be it a refractor, lens or globe related to the present invention is of a flammable or fusible plastic material selected from the group of transparent or translucent optical plastics consisting of polyolefins such as polymethylmethacrylate, polystyrene, polyethylene, and fluorocarbons, and other plastics such as cellulosics, polycarbonates, and polyesters. These optical devices may also be formed of thin films of organic material which may not ignite when subjected to particles of hot quartz, in a manner to be described, but may melt and allow hot quartz to drop below the confines of the related luminaire.

As discussed in the "Background" section, the lamp 14 such as a metal halide lamp or possibly a tungsten-halogen type, may unlikely encounter a rupture or non-passive explosive condition. Under such unlikely conditions, the non-passive lamp may dislodge or project hot pieces of the quartz arc tube of the lamp 14 that, without the benefits of the present invention, may otherwise reach the lenses, refractors or globes of the embodiments of FIGS. 1, 2 and 3, and which being formed of a flammable or fusible plastic material such as acrylic may be ignited or damaged in an excess manner as discussed in the "Background" section.

In my pursuit to find a solution to prevent the ignition or fusible damage to the luminaire, it was determined that while the rupturing of the arc tube may cause the projection of hot quartz particles of all size from that of microscopic dimensions to those of relatively large dimensions, only particles of certain dimensions and characteristics are the main contributors to the damage desired to be prevented. It was determined that such contributing particles are in excess of a particular size so as to have sufficient heat capacity and be of a sufficient temperature to start or ignite a fire of the flammable material on which these particles land. It was determined quartz particles of between about ¼ inch square to about ½ inch square or greater projected from a typical arc tube having an operating temperature in excess of about 1100° C., are of sufficient heat capacity and temperature to cause excessive heat or fire damage to the luminaire. Projected quartz particles of less than ¼ inch square upon arriving at the lenses, refractor or globes, do not impart enough energy to start or ignite a fire of concern.

Upon such determination, it was realized that if a containment means, in the form of a mesh having openings small enough to prevent passage of hot quartz particles having a heat capacity which is great enough to ignite the flammable device and yet such opening being large enough to yield adequate optical transmission, was interposed between the metal halide lamp 14 and the flammable device such as the refractor 22 of FIG. 1, the globe 32 of FIG. 2 or the window 42 of FIG. 3, then such a mesh would prevent the hot quartz particles having the discussed sufficient heat capacity and temperature from reaching the flammable device and thereby prevent the flammable device from encountering any burning conditions that may otherwise create fire damage. It was further realized that mesh openings of less, than 5/32 of an inch and preferably ¼ of an inch or less measured in a diagonal manner, serve the desired purpose of the containment means.

It should now be appreciated that the practice of the present invention provides containment means for a luminaire that intercepts and captures any hot particles large enough to cause a fire in an acrylic enclosure under the unlikely event of a pressurized lamp rupturing condition.

What I claim as new and desire to secure by Letters Patent of the United States is:

1. A luminaire comprising;

(a) an upper housing;

(b) a pressurized lamp accommodated by said upper housing, said pressurized lamp capable of encountering a non-passive explosive condition so as to project hot quartz particles having predetermined dimensions, heat capacity and temperatures;

(c) an enclosure having a window area and said enclosure capable of being ignited if subjected to encountering said hot quartz particles and;

(d) a mesh assembly interposed between said pressurized lamp and said window area of said enclosure, said mesh having openings small enough to prevent passage of said hot quartz particles having said heat capacities and said temperatures which are great enough to ignite said enclosure and yet such mesh openings being large enough to yield adequate optical transmission.

2. A luminaire according to claim 1 wherein said enclosure has its window area opened and said mesh is attached around the outer rim of said enclosure.

3. A luminaire according to claim 1 wherein said enclosure is of a globe shape.

4. A luminaire according to claim 1 wherein said enclosure is of a rectangular shape.

5. A luminaire according to claim 1 wherein said enclosure has attachment means to which is connected a window member for closing the window area of said enclosure.

6. A luminaire according to claim 3 wherein said enclosure is of a material selected from the group of (1) plastics consisting of polyolefins including polymethylmethacrylate, polystyrene, polyethylene, and fluorocarbons, (2) plastics including cellulosics, polycarbonates, and polyesters, and (3) thin films of organic material which melt when subjected to particles of about one-quarter square inch dimensions having a temperature in excess of 1100° C.

7. A luminaire according to claim 4 wherein said enclosure is of a material selected from the group of (1) plastics consisting of polyolefins including polymethylmethacrylate, polystyrene, polyethylene, and fluorocarbons, (2) plastics including cellulosics, polycarbonates, and polyesters, and (3) thin films of organic material which melt when subjected to particles of about one-quarter square inch dimensions having a temperature in excess of 1100° C.

8. A luminaire according to claim 5 wherein said window member is of a material selected from the group of (1) plastics consisting of polyolefins including polymethylmethacrylate, polystyrene, polyethylene, and fluorocarbons, (2) plastics including cellulosics, polycarbonates, and polyesters, and (3) thin films of organic material which melt when subjected to particles of about one-quarter square inch dimensions having a temperature in excess of 1100° C.

9. A luminaire according to claim 1 wherein said mesh assembly has openings from about less than 5/32 of an inch to about ¼ of inch each being measured in a diagonal manner.

10. A luminaire according to claim 1 wherein said mesh is selected of a material having a melting point high enough so that the mechanical integrity of the mesh is not damaged when subjected to particles of a quartz material having physical dimension of greater than one-quarter inch square and at a temperature of about 1100° C.

11. A luminaire according to claim 1 wherein said mesh assembly is of a stainless steel material.

12. A luminaire according to claim 1 wherein said mesh is of a high melting point material selected from the group consisting of aluminum, brass, copper, steel and alloys thereof.

13. A luminaire according to claim 1 wherein said mesh is of a high melting point plastic material selected from the group of silicone and fluorocarbons.

14. A luminaire according to claim 1 wherein said mesh assembly is of a glass material.

15. A luminaire according to claim 1 wherein said mesh assembly is of an inorganic material.

* * * * *